US007222848B2

(12) United States Patent
Elliott et al.

(10) Patent No.: US 7,222,848 B2
(45) Date of Patent: May 29, 2007

(54) METHOD AND DEVICE TO CONTROL THE ALIGNMENT OF A MEDIA SHEET IN AN IMAGE FORMING DEVICE

(75) Inventors: Delbert Lester Elliott, Georgetown, KY (US); Paul D. Horrall, Lexington, KY (US); Derek Masami Inouye, Lexington, KY (US); John Randolph McIntyre, Lexington, KY (US); Matthew Christopher Coriale, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 498 days.

(21) Appl. No.: 10/767,154

(22) Filed: Jan. 29, 2004

(65) Prior Publication Data

US 2005/0167906 A1 Aug. 4, 2005

(51) Int. Cl.
*B65H 9/00* (2006.01)

(52) U.S. Cl. ..... 271/226

(58) Field of Classification Search ..... 271/226, 271/227, 228, 291, 65; 399/309, 364, 45, 399/21, 18, 16

See application file for complete search history.

(56) References Cited

U.S. PATENT DOCUMENTS

| | | | | |
|---|---|---|---|---|
| 4,360,279 | A | 11/1982 | Sugiura | |
| 4,919,318 | A | 4/1990 | Wong | |
| 5,171,977 | A | 12/1992 | Morrison | |
| 5,253,862 | A | 10/1993 | Acquavina | |
| 5,601,283 | A | 2/1997 | Pinckney | |
| 5,970,277 | A | 10/1999 | Shigeta et al. | |
| RE37,007 | E | 1/2001 | Gerlier | |
| 6,173,952 | B1 | 1/2001 | Richards et al. | |
| 6,273,418 | B1 | 8/2001 | Fujikura et al. | |
| 6,373,042 | B1 * | 4/2002 | Kretschmann et al. | 250/208.1 |
| 6,375,180 | B1 | 4/2002 | Kawano et al. | |
| 6,381,422 | B1 | 4/2002 | Tanaka | |
| 6,385,406 | B1 | 5/2002 | Funamizu et al. | |
| 6,533,268 | B2 | 3/2003 | Williams et al. | |
| 6,575,458 | B2 | 6/2003 | Williams et al. | |
| 6,578,844 | B2 | 6/2003 | Acquaviva et al. | |
| 6,920,307 | B2 * | 7/2005 | Howe | 399/395 |

FOREIGN PATENT DOCUMENTS

JP 2002-284399 * 10/2002

OTHER PUBLICATIONS

Computer generated English translation of Japanese Publication No. 2002-284399.*

* cited by examiner

*Primary Examiner*—Patrick Mackey
*Assistant Examiner*—Thomas Morrison
(74) *Attorney, Agent, or Firm*—Coats & Bennett PLLC

(57) ABSTRACT

A device and method for aligning a media sheet moving along a media path. An amount of skew that will occur as the media sheet moves along the media path is determined based on one or more physical characteristics. Previous testing of the device indicates that media sheets having particular physical characteristics will have a known amount of skew by the time they reach a predetermined location along the media path. The media sheet is moved the known amount so the media sheet is aligned. Test data is used to determine the amount of expected misalignment of the media sheet and the amount necessary to move the media sheet back into alignment.

19 Claims, 4 Drawing Sheets

METHOD AND DEVICE TO CONTROL THE ALIGNMENT OF A MEDIA SHEET IN AN IMAGE FORMING DEVICE

BACKGROUND

Image forming devices move media sheets throughout a media path. The media sheets are moved along the media path past one or more imaging stations where an image is transferred to the sheet. The media path may further include a duplexer. A duplexer is a device that receives a media sheet from the forming device, inverts the sheet, and then conveys the sheet back to the imaging stations for an image to be formed on the second side. The sheet may or may not have an image formed on the first side when the sheet is received by the duplexer.

Correct positioning and alignment is necessary for the image to be accurately transferred to the media sheets. Misalignment of the media sheets when moving past one or more of the imaging stations may cause the image formed on the media sheet to be misaligned resulting in a print defect. Further, an excessive amount of skew within the media sheet may cause a media jam. Clearing a media jam requires the operator to manually remove the jammed media sheets from the media path and reset the image forming device.

Image forming devices are capable of forming images of various types on various types of media sheets. Each of the media sheets has different physical characteristics that affect the way the media sheets move along the media path. The media path may be calibrated to accurately move one type of media sheet, but cause skew when moving a second type of media sheet.

Determining the amount of skew on a media sheet moving through a media path may be difficult. It may be necessary to position one or more sensors along the media path to detect the amount of skew. However, sensors may incorrectly determine the amount of skew on the media sheet. Additionally, sensors are expensive. Many purchasers of image forming devices make their purchasing decisions based mainly on cost. Therefore, any unnecessary costs are preferably removed to make the device more attractive to the purchaser.

SUMMARY

The present invention is directed to a device and method for aligning a media sheet while the sheet is moving along a media path. The amount of skew that will occur as the media sheet moves along the media path is determined based on one or more physical characteristics of the media sheet. Previous testing of the device indicates that media sheets having particular physical characteristics will have a known amount of skew by the time they reach a predetermined location along the media path. The media sheet is moved in the opposite direction of the skew by the known amount so the media sheet becomes properly aligned. The present invention does not prevent the skew from occurring, and does not detect an amount of skew. The present invention relies on historical information to know that the media sheet will be misaligned once it reaches the predetermined location, and how far the media sheet will need to be moved to return it to the proper alignment.

In one embodiment, the method includes determining at least one physical characteristic of the media sheet, either through operator input, or through sensors along the media path. The firmware on the image forming device associates the amount of that characteristic with the amount of misalignment that will occur by the time the media sheet moves through the media path to a predetermined point. This amount of misalignment is based on at least one physical characteristic of the sheet and historical data on how the characteristic affects alignment. As the media sheet moves along the media path, the media sheet is moved in such a way to correct the misalignment. The amount is not based on the actual sensed amount of misalignment, but rather on the expected amount of misalignment.

DETAILED DESCRIPTION

Figure 1:
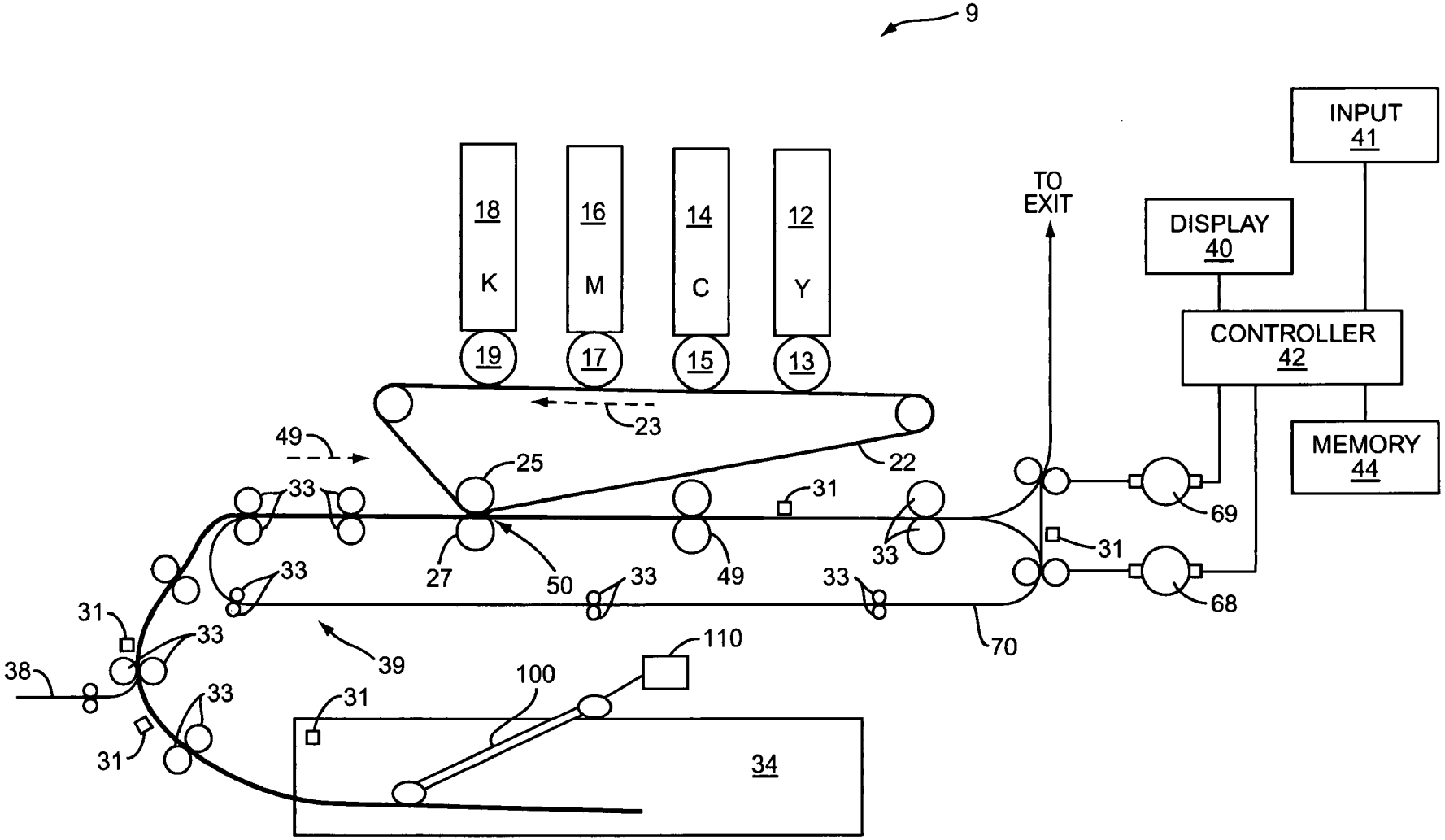
FIG. 1 is a partial schematic side view of one embodiment of an image forming device according to the present invention.

The present invention is directed to an image forming device, generally illustrated as 9 in FIG. 1, that automatically adjusts the speed differential between two sections of the media path to correct skew of the media sheet. The adjustment in the speed differential is based on one or more of the physical characteristics of the media sheet.

FIG. 1 illustrates one embodiment of an image forming device 9. A plurality of toner cartridges 12,14,16,18 each have a corresponding photoconductive drum 13, 15, 17, 19. Each toner cartridge has a similar construction but is distinguished by the toner color contained therein. In one embodiment, the device 9 includes a black cartridge 18, a magenta cartridge 16, a cyan cartridge 14, and a yellow cartridge 12. The different color toners form individual images in their respective color that are combined in layered fashion to create the final multicolored image.

Each photoconductive drum 13, 15, 17, 19 has a smooth surface for receiving an electrostatic charge from a laser assembly (not illustrated). The drums continuously and uniformly rotate past the laser assembly that directs a laser beam onto selected portions of the drum surfaces forming an electrostatic latent image representing the image to be printed. The drum is rotated as the laser beam is scanned across its length. This process continues as the entire image is formed on the drum surface.

After receiving the latent image, the drums rotate past a toner area having a toner bin for housing the toner and a developer roller for uniformly transferring toner to the drum. The toner is a fine powder usually composed of plastic granules that are attracted to the electrostatic latent image formed on the drum surface by the laser assembly.

An intermediate transfer medium (ITM) belt 22 receives the toner images from each drum surface. As illustrated in FIG. 1, the ITM belt 22 is endless and extends around a series of rolls adjacent to the drums 13, 15, 17, 19 as it moves in the direction indicated by arrow 23. The ITM belt 22 and drums 13, 15, 17, 19 are synchronized providing for the toner image from each drum to precisely align in an overlapping arrangement. In one embodiment, a multi-color toner image is formed during a single pass of the ITM belt 22. By way of example as viewed in FIG. 1, the yellow (Y) toner is placed first on the ITM belt 22, followed by cyan (C), magenta (M), and black (K). In one embodiment, ITM belt 22 makes a plurality of passes by the drums to form the overlapping toner image.

ITM belt 22 moves the toner image towards a second transfer point 50 where the toner images are transferred to a media sheet. A pair of rolls 25, 27 form a nip where the toner images are transferred from the ITM belt 22 to the media sheet. The media sheet with toner image then travels through a fuser 49 where the toner is adhered to the media sheet. The media sheet with fused image is then either output from the device 9, or is routed through a duplexer 70 for image formation on a second side.

Media path 39 is formed by a series of nip rolls 33 spaced a distance apart. The nip rolls 33 are spaced such that the media sheet remains in contact with at least one set of nip rolls 33. The nip rolls 33 may further be spaced such that the media sheet is simultaneously contacted by adjacent nip rolls 33. The amount of simultaneous contact may vary.

Figure 3:
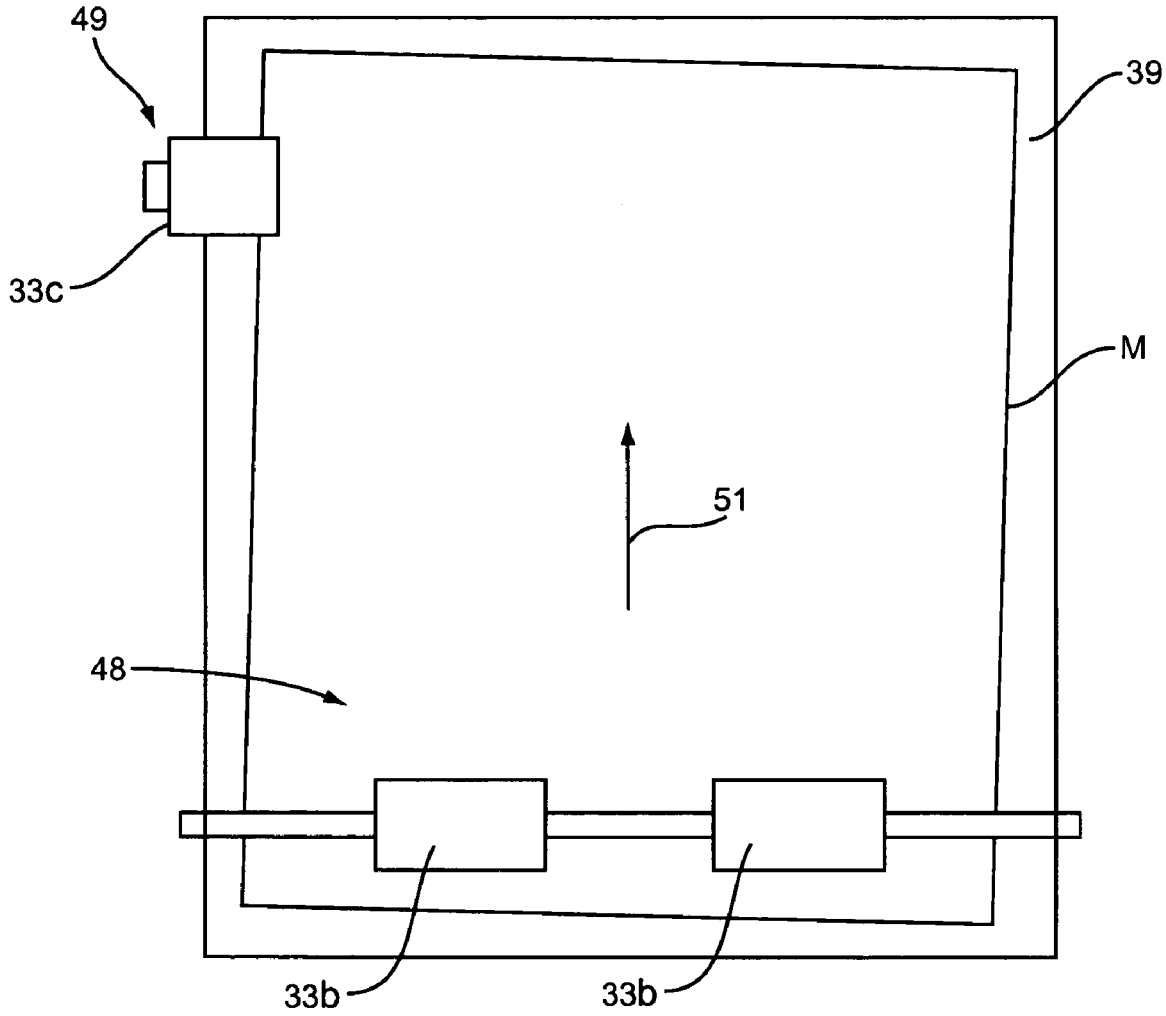
FIG. 3 top view of a media sheet moving along the media path and being simultaneously in contact with two nip rolls according to one embodiment of the present invention.

Nip rolls 33 include a first drive roller that is in contact with a second driven roller. The two rollers are spaced a distance apart to contact each other creating a nip point. The rollers contact the top and bottom sides of the media sheets to convey them along the media path. Nip rolls 33 may include multi-contact rolls 48 and single-contact rolls 49 as best illustrated in FIG. 3. Multi-contact rolls 48 include two or more sets of nip rollers spaced along the width of the media sheet. Single-contact rolls 49 include a single set of nip rolls. The nip rollers may be spaced relative to the center of the media path 39, or an alignment reference, such as the edge of the media path, for both the multi-contact rolls 48, and the single contact rolls 49.

The nip rolls 33 are rotated by one or more motors 68, 69 that control the speed and position of each media sheet as it moves along the media path 39. Motors 68, 69 are controlled by a controller 42 that oversees the image forming process. FIG. 1 illustrates one embodiment having two motors 68, 69 that control the nip rolls 33 along the media path 39. Various numbers of motors may be positioned along the media path 39 to control the speed of the rolls 33.

Controller 42 oversees the timing of the toner images and the media sheets, and the overall image forming process. In one embodiment as illustrated in FIG. 1, controller 42 includes a microprocessor with associated memory 44. In one embodiment, controller 42 includes a microprocessor, random access memory, read only memory, and an input/output interface. A display 40 may further be operatively connected to the controller 42 for displaying messages to an operator. The display 40 may include an LED or LCD array to display alpha-numeric characters. Input 41 is operatively connected to the controller 42 for the operator to input data relevant to the image forming process. In one embodiment, input 41 is a keypad associated with the display 40.

The media path 39 extends between an input tray 34, the second transfer 50, fuser 49, duplexer 70, and exit. Media sheets are introduced into the media path 39 in a variety of different manners. In one method, an input tray 34 holds a stack of media sheets, and a pick mechanism 100 picks a topmost sheet from the stack and feeds it towards the first nip rolls. The embodiment illustrated in FIG. 1 includes a single input tray 34. Multiple input trays having various media capacity and being able to hold various media sizes may also be included to introduce media sheets. A multi-purpose feeder 38 provides another method of introducing media sheets into the media path 39. Media sheets are manually loaded by an operator into the multi-purpose feeder 38 and into the media path 39.

The present invention corrects the alignment of a media sheet as it moves along the media path 39. Media sheets moving along the media path 39 become misaligned by a known skew amount that is based on the particular physical characteristics of the media sheet. The present invention does not prevent the misalignment, and does not detect the actual skew amount. The present invention assumes the media sheet will become misaligned while moving along the media path 39, and uses historical data to determine the skew and remove it.

The image forming device 9 forms images of various types of media sheets. Media sheets include but are not limited to various weights, textures, and thicknesses of paper, cardstock, transparencies, envelopes, etc. Each of these media sheets has different physical characteristics that affect their movement through the media path 39. These physical characteristics include but are not limited to friction coefficient, weight, grain, beam strength, thickness of the media sheet, width, and length.

The physical characteristics can be ascertained by operator input, or by sensors 31. In one embodiment, the operator is prompted through the display 40 to enter the necessary physical characteristics of the media sheet. The prompt may seek from the operator the specific characteristic (e.g., what is the paper weight?), or ask for a general nature of the sheet (e.g., is the media sheet a transparency?) from which controller 42 determines the specific physical characteristics. In one embodiment, the display 40 lists the possible types of media sheets that can be used within the device 9 and the operator selects the appropriate answers and enters them through the input 41. The operator may be prompted for the physical characteristic at the time of the print request, or when the media sheets are introduced into the input tray 34 or the multi-purpose feeder 38.

In another embodiment, sensors 31 are placed about the media path 39 to detect the physical characteristics. Each sensor 31 is operatively connected to the controller 42 to provide the physical characteristics. In one embodiment as illustrated in FIG. 1, sensors 31 are positioned within the input tray 34, and at several positions along the remaining media path 39. In one embodiment, sensors 31 are optical sensors that include an emitter that transmits a signal and a receiver that receives the signal. One embodiment includes the sensor 31 having a light-emitting diode as the emitter and a phototransistor as the receiver.

The skew amount that will result as the media sheet moves along the media path 39 is previously ascertained for each of the possible type of media sheet. Further the media path adjustments necessary to remove the skew are ascertained and stored within the controller 42. One media path adjustment includes changing the speed differential between adjacent nips rolls 33 at a point along the media path 39.

Figure 2:
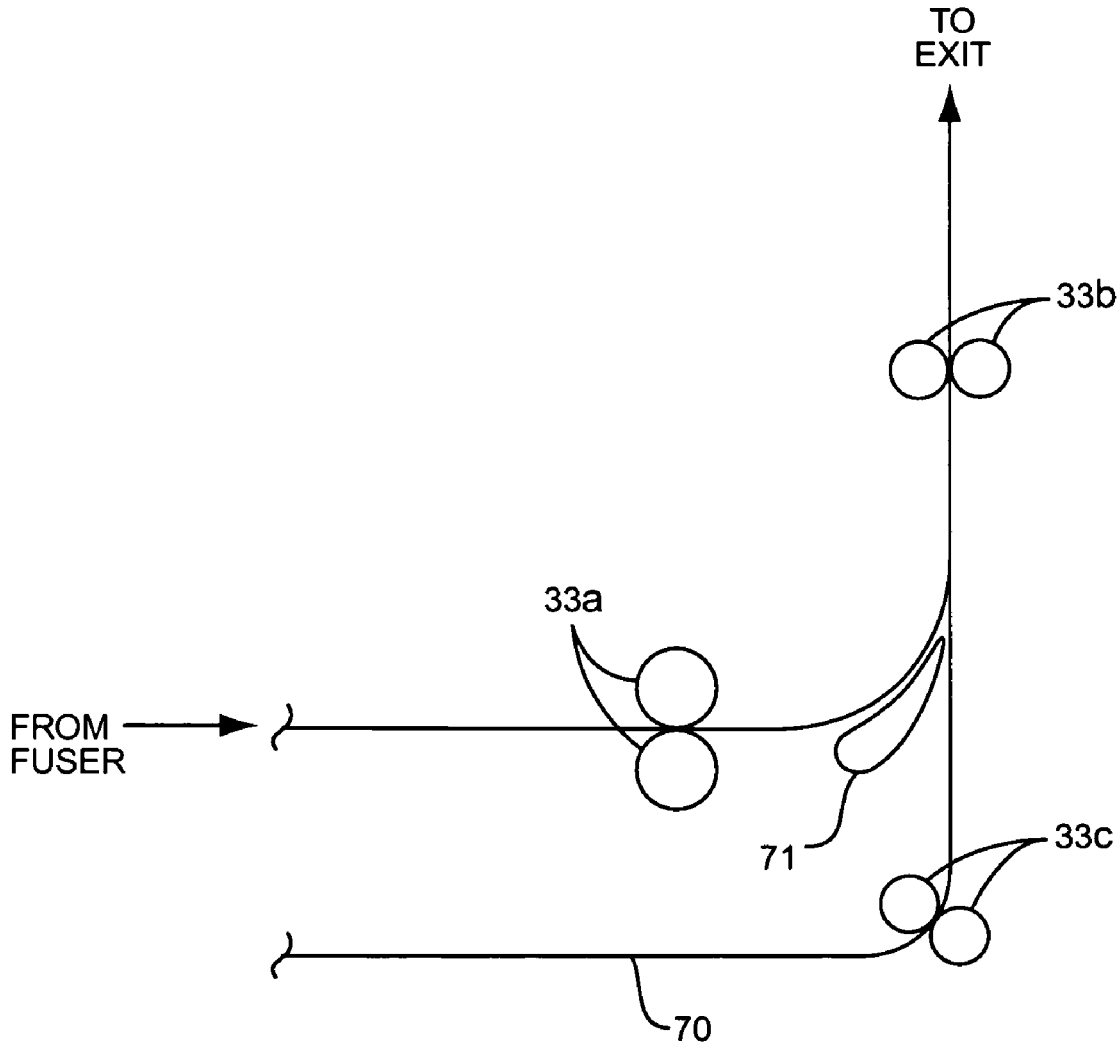
FIG. 2 is a schematic view of the section of the media path that leads into the duplexer according to one embodiment of the present invention.

FIG. 2 illustrates the entrance to the duplexer 70 which causes skew to be introduced to the media sheet having predetermined physical characteristics. The media sheets move from the fuser 49 into a first nip roll, referred to as the entry drive roll 33*a*. The media sheets are directed by diverter 71 towards the exit and a second nip roll, referred to as the forward/reverse roll 33*b*. Forward/reverse roll 33*b* rotates in a first direction to move sheets towards the exit of the device 9. For a duplexed sheet, once a trailing edge of the media sheet clears the diverter 71, the diverter pivots to open the duplexer path 70 and the forward/reverse roll 33*b* reverses to a second direction. The media sheet is initially driven by the forward/reverse roll 33*b* and then handed-off to another nip roll, referred to as the entry align roll 33*c*.

As the media sheet is being conveyed, there is a prescribed time in which the media sheet is driven simultaneously by both the forward/reverse roll 33*b* and the entry align roll 33*c*. During the time of simultaneous contact the speed differential between the two contacting nip rolls is adjusted to remove the skew amount. By the time the media sheet has moved to a position downstream such that the trailing edge has passed the forward/reverse roll 33*b*, the skew amount has been removed. At that point, the media sheet is aligned within the media path 39. The speed differential of the two nip rolls is maintained within the controller 42 and based on the one or more physical characteristics of the media sheet. The speed differential may be adjusted by leaving the speed of one of the nip rolls the same and adjusting the second nip roll, or adjusting the speed of both nip rolls.

FIG. 3 illustrates one embodiment of the forward/reverse roll 33*b* and the entry align roll 33*c*. The forward/reverse roll 33*b* is a multi-contact roll having at least two points of contact across the width of the media sheet. The entry align roll 33*c* is a single-contact roll with a single contact point at the edge of the media sheet. As the media sheet moves along the media path 39 in the direction of arrow 51 and in contact with both nip rolls, controller 42 adjusts the speed differential of the nip rolls. In this embodiment, the speed of the forward/reverse roll 33*b* is controlled as a percentage of the entry align roll 33*c*. A higher speed differential for the forward/reverse roll 33*b* with respect to the entry align roll 33*c* results in a forward rotation of the media edge opposite the entry align roll 33*c*. A lower speed differential results in the opposing effect. In one embodiment, a speed differential of 60% will result a forward rotation away from the entry align roll 33*c*, and a speed differential of 125% will result in a forward rotation towards the entry align roll 33*c*. By assigning the various speed differentials for the various physical characteristics of the media sheets, the media sheets are aligned at the duplexer 70 resulting in improved print formation for the images formed on the second side.

FIG. 3 corrects skew caused as the media sheet is introduced into the duplexer 70. The speed differential between nip rolls may also occur at other locations along the media path 39. In one embodiment, the location is downstream from the input tray 34 to correct skew caused when the media sheet is picked by the pick mechanism 100. In another embodiment, the location is downstream from the fuser 49.

FIGS. 2 and 3 illustrate skew adjustment by adjusting the speed differential between nip rolls. Other forms of skew adjustment may also be used by the present invention. Those other forms of skew adjustment include but are not limited to adjusting skew using the angle of the nip rolls with respect to the media path and adjusting skew using predetermined forces between the top and bottom nip rolls.

Figure 4:
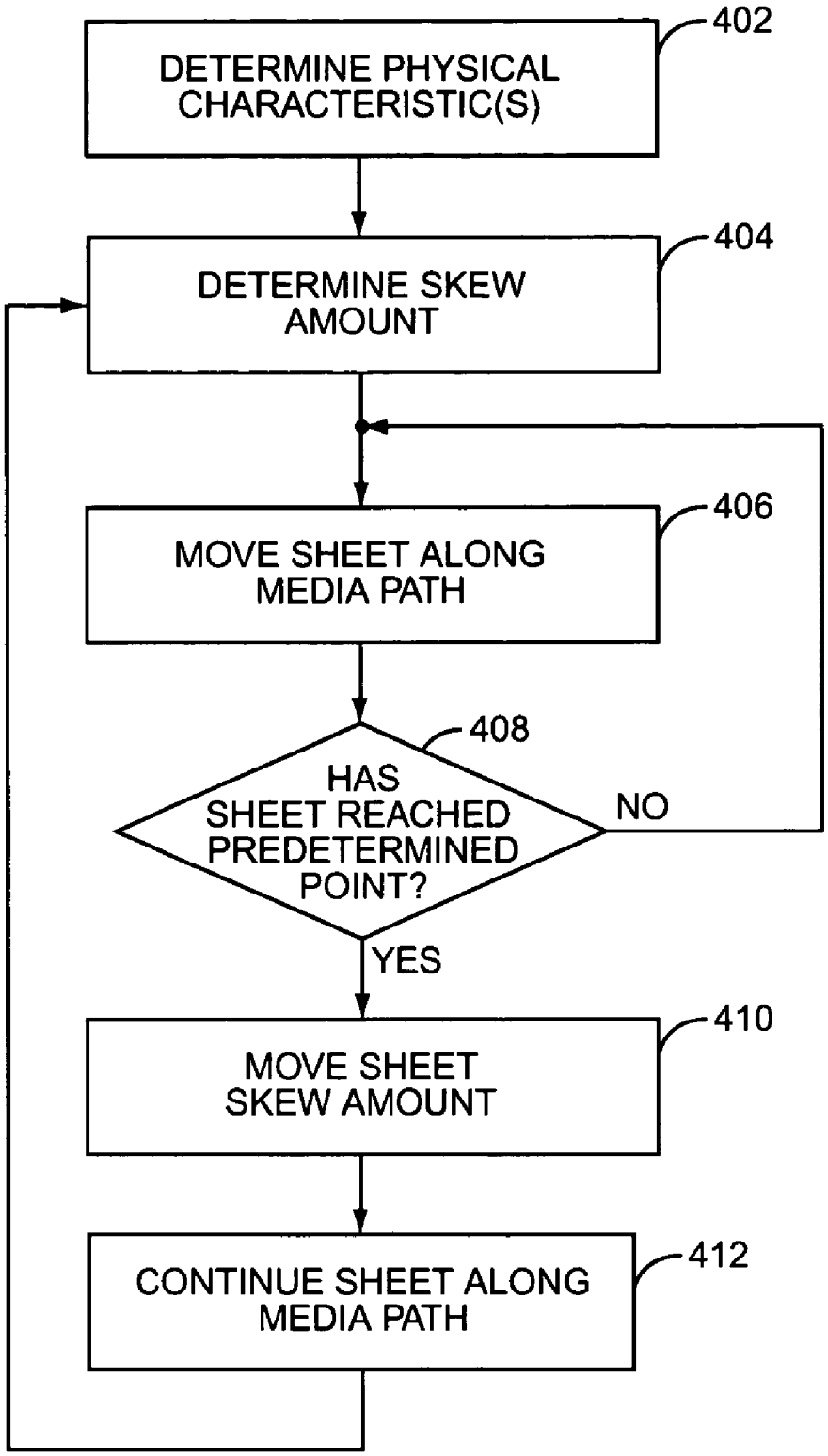
FIG. 4 is a flowchart diagram of the steps of one embodiment of aligning a media sheet while it is moving along the media path.

FIG. 4 illustrates the steps of one embodiment of aligning a media sheet moving along the media path 39. One or more physical characteristics of the media sheet is ascertained by either input from the operator or detected by sensors 31 (step 402). Next, the skew amount is determined based on one or more physical characteristics (step 404). The media sheet is then moved along the media path 39 (step 406) until it reaches a predetermined point (step 408). Once the sheet has reached the predetermined point, the sheet is moved an amount (step 410) to remove the unwanted skew. The present invention does not attempt to prevent the media sheet from becoming misaligned, and does not determine the actual amount of skew of the media sheet at the predetermined position. Rather, the sheet is automatically moved the amount to remove the expect amount of skew. The media sheet is then moved through the remainder of the media path 39 (step 412).

FIG. 1 illustrates one embodiment of the image forming device 9. The embodiment of FIG. 1 is a color laser printer, however, the present invention is also applicable to other types of image forming devices that move media sheets during the image formation process. The embodiment illustrated in FIG. 1 comprises separate cartridges for each different color. The present invention is not limited to this embodiment, and may also be applicable to image forming device featuring a single cartridge.

Skew may be introduced to the media sheet as it moves through a particular point of the media path 39, such as when the media sheet enters into the duplexer 70. Skew may also gradually increase as the media sheet moves along the media path 39.

In one embodiment, display 40 and input 40, 41 are positioned on the device 9. In another embodiment, input 40 and display 41 may be remote from the device 9, such as a computer terminal that is connected to the device 9 through a network or connected directly by cable.

The present invention may be carried out in other specific ways than those herein set forth without departing from the scope and essential characteristics of the invention. In one embodiment, media type having one or more particular characteristics may result in no skew induced to the media sheet. Therefore, the controller 42 does not make any adjustments along the media path 39. In one embodiment, the physical characteristic of the media sheet is specified by the user through a pc-based driver utility. The present embodiments are, therefore, to be considered in all respects as illustrative and not restrictive, and all changes coming within the meaning and equivalency range of the appended claims are intended to be embraced therein.

What is claimed is:

1. A method of aligning a media sheet moving along a media path, the method comprising the steps of:

determining at least one physical characteristic of the media sheet;

determining an expected amount of skew that will result as the media sheet moves through the media path based on the at least one physical characteristic;

moving the media sheet along a predetermined distance of the media path;

while the media sheet is in contact with first and second rolls spaced along the media path, adjusting a speed differential between the first and second rolls based on the at least one physical characteristic of the media sheet; and moving the media sheet along the media path through the first and second rolls at the speed differential to remove the expected amount of skew.

2. The method of claim 1, further comprising moving the second roll at a first speed when the media sheet is in contact with both the first roll and the second roll, and adjusting the second roll to a second speed different than the first speed once the media sheet has moved beyond contact with the first roll.

3. The method of claim 1, wherein the step of determining at least one physical characteristic comprises receiving information from an input.

4. The method of claim 3, further comprising displaying a prompt on a display requesting a user to input the at least one physical characteristic.

5. The method of claim 3, further comprising receiving the at least one physical characteristic through a pc-based driver utility.

6. The method of claim 1, wherein the step of determining at least one physical characteristic comprises moving the media sheet through a sensor along the media path that determines the at least one physical characteristic.

7. The method of claim 1, wherein the step of determining at least one physical characteristic of the media sheet comprises determining a weight of the media sheet.

8. The method of claim 1, wherein the step of determining at least one physical characteristic of the media sheet comprises determining a thickness of the media sheet.

9. The method of claim 1, wherein the step of determining the at least one physical characteristic of the media sheet comprises determining the texture of the media sheet.

10. The method of claim 1, further comprising applying the speed differential as the media sheet is moving through a first media path location where the first roll contacts the media sheet at a single point and a second media path location where the second roll contacts the media sheet at multiple points.

11. A method of aligning a media sheet moving along a media path, the method comprising the steps of:

determining at least one physical characteristic of the media sheet;

determining an expected amount of misalignment of the media sheet from proper alignment at a predetermined point along the media path based on the at least one physical characteristic;

storing the amount of misalignment in a controller;

introducing the media sheet into the media path;

moving the media sheet along the media path;

once the media sheet reaches the predetermined point, automatically moving the media sheet by the amount of misalignment.

12. A method of aligning a media sheet moving through a media path, the method comprising the steps of:

determining at least one physical characteristic of the media sheet;

determining an expected amount of skew that will result as the media sheet moves through the media path based on the at least one physical characteristic;

moving the media sheet along a predetermined distance of the media path;

while the media sheet is at a first media path location where a first roll contacts the media sheet at a single point and a second media path location where a second roll contacts the media sheet at multiple points, adjusting a speed differential of the first roll at the first media path location and the second roll at the second media path location based on the at least one physical characteristic of the media sheet; and moving the media sheet along the media path through the first and second media path locations at the speed differential and removing the expected amount of skew.

13. The method of claim 12, comprising moving the media sheet through the second media path location and then through the first media path location.

14. A method of aligning a media sheet moving through a media path, the method comprising the steps of:

determining at least one physical characteristic of the media sheet;

determining a skew amount that will result as the media sheet moves through the media path based on the at least one physical characteristic;

moving the media sheet along a predetermined distance of the media path to be in simultaneous contact with a first roll and a second roll;

during the simultaneous contact, adjusting a speed of the first roll to a predetermined percentage of a speed of the second roll, with the predetermined percentage based on the at least one physical characteristic and the skew amount; and moving the media sheet along the media path by contact with the first roll and the second roll with the first roll and second roll rotating at different speeds.

15. The method of claim 14, comprising removing the skew amount while the media sheet is still in the simultaneous contact with the first roll and the second roll.

16. The method of claim 14, further comprising after the media sheet moves beyond the first roll and while still in contact with the second roll, adjusting the speed of the second roll.

17. The method of claim 14, comprising the simultaneous contact occurring when the media sheet is in contact with the first roll which includes a single contact point at a first media path location and the second roll which includes multiple contact points at a second media path location.

18. A method of aligning a media sheet moving along a media path, the method comprising the steps of:

determining at least one physical characteristic of the media sheet;

determining an amount of skew resulting from moving the media sheet into a duplex path based on the at least one physical characteristic;

forming an image on a first side of the media sheet;

reversing a direction of the media sheet and moving the media sheet into the duplex path;

while the media sheet is in simultaneous contact between a first roll and a second roll, rotating the first roll at a first speed and rotating the second roll at a second speed with the difference between the first speed and the second speed based on the at least one physical characteristic of the media sheet; and moving the media sheet along the duplex path while in contact with the first roll and the second roll and removing the amount of skew.

19. A method of aligning a media sheet moving along a media path, the method comprising the steps of:

determining at least one physical characteristic of the media sheet;

determining an amount of skew resulting from moving the media sheet into a duplex path based on the at least one physical characteristic;

forming an image on a first side of the media sheet;

reversing a direction of the media sheet and moving the media sheet along the duplex path;

while the media sheet is in simultaneous contact at a first media path location with a first roll and a second media path location with a second roll, adjusting a speed of the first roll which includes a single contact point at the first media path location to be different than a speed of the second roll which includes multiple contact points at the second media path location; and moving the media sheet along the duplex path while in contact with the first roll at the first media path location and the second roll at the second media path location with the first roll and the second roll rotating at different speeds and removing the amount of skew.

* * * * *